US007413376B2

(12) United States Patent
Potts et al.

(10) Patent No.: US 7,413,376 B2
(45) Date of Patent: Aug. 19, 2008

(54) ASPHALT-REMOVING MACHINE HAVING A FUNNEL-SHAPED RAMP

(75) Inventors: Dean Rogers Potts, Maple Grove, MN (US); Andrew Harold Tilstra, Luverne, MN (US); Jeffrey A. Renard, Forest Lake, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 214 days.

(21) Appl. No.: 11/117,523

(22) Filed: Apr. 29, 2005

(65) Prior Publication Data

US 2006/0045623 A1 Mar. 2, 2006

Related U.S. Application Data

(60) Provisional application No. 60/604,982, filed on Aug. 27, 2004.

(51) Int. Cl.
*E01C 23/12* (2006.01)
*E01C 23/00* (2006.01)
*E01C 23/07* (2006.01)

(52) U.S. Cl. ..... 404/90; 404/91; 404/92; 404/93; 404/94

(58) Field of Classification Search ..... 404/90–96
See application file for complete search history.

(56) References Cited

U.S. PATENT DOCUMENTS

| | | | | | |
|---|---|---|---|---|---|
| 1,483,080 | A | | 2/1924 | Currie | |
| 2,086,469 | A | * | 7/1937 | Bullard | 404/95 |
| 3,843,274 | A | * | 10/1974 | Gutman et al. | 404/91 |
| 4,175,886 | A | * | 11/1979 | Moench et al. | 404/90 |
| 4,226,552 | A | * | 10/1980 | Moench | 404/92 |
| 4,347,016 | A | | 8/1982 | Sindelar et al. | |
| 4,374,602 | A | | 2/1983 | Gurries et al. | |
| RE31,669 | E | | 9/1984 | Eigenmann | |
| 4,545,700 | A | * | 10/1985 | Yates | 404/75 |
| 4,560,207 | A | * | 12/1985 | Eftefield et al. | 299/10 |
| 4,659,250 | A | | 4/1987 | Nelson | |
| 4,676,688 | A | * | 6/1987 | Caradot | 404/91 |
| 4,692,058 | A | | 9/1987 | Mengel | |
| 4,850,740 | A | * | 7/1989 | Wiley | 404/79 |

(Continued)

FOREIGN PATENT DOCUMENTS

CA 2271585 * 5/1999

(Continued)

OTHER PUBLICATIONS

"A Friend in Need, a Visionary Caterpillar Customer Story", by Dean R. Potts.

*Primary Examiner*—Raymond W Addie
(74) *Attorney, Agent, or Firm*—Finnegan, Henderson, Farabow, Garrett & Dunner

(57) ABSTRACT

A work machine for removing asphalt from a roadway is disclosed. The work machine includes a removal device configured to remove asphalt from a roadway surface, and a grinding device configured to fracture the removed asphalt. The work machine also includes a funnel-shaped ramp configured to guide the removed asphalt from the removal device to the grinding device. A width of the removal device is larger than a width of the grinding device, and the funnel-shaped ramp is configured to fold the outer edges of the removed asphalt over itself before the removed asphalt reaches the grinding device.

30 Claims, 4 Drawing Sheets

U.S. PATENT DOCUMENTS

| | | | | | |
|---|---|---|---|---|---|
| 4,874,283 | A | | 10/1989 | Hurley, Jr. | |
| 5,026,205 | A | * | 6/1991 | Gorski et al. | 404/72 |
| 5,026,206 | A | * | 6/1991 | O'Connor | 404/77 |
| 5,178,484 | A | * | 1/1993 | Strunk | 404/75 |
| 5,354,146 | A | * | 10/1994 | O'Konek | 299/39.2 |
| 5,419,654 | A | | 5/1995 | Kleiger | |
| 5,427,185 | A | | 6/1995 | Seal | |
| 5,697,731 | A | * | 12/1997 | Bonds | 404/92 |
| 5,741,085 | A | * | 4/1998 | Wirtgen | 404/75 |
| 5,921,706 | A | * | 7/1999 | Manatt et al. | 404/72 |
| 6,022,168 | A | * | 2/2000 | Junker | 404/6 |
| 6,439,804 | B1 | | 8/2002 | Crupi | |
| 2006/0045621 | A1 | | 3/2006 | Potts et al. | |
| 2006/0045622 | A1 | | 3/2006 | Potts et al. | |

FOREIGN PATENT DOCUMENTS

| | | | | |
|---|---|---|---|---|
| CH | 672516 | A5 | * | 11/1989 |
| EP | 0 197 833 | A1 | | 10/1986 |
| GB | 1 308 311 | | | 2/1973 |
| GB | 2093893 | A1 | * | 9/1982 |
| SU | 394507 | | | 8/1973 |
| WO | WO 94/06965 | | | 3/1994 |

* cited by examiner

ASPHALT-REMOVING MACHINE HAVING A FUNNEL-SHAPED RAMP

RELATED APPLICATIONS

This application claims the benefit of U.S. Provisional Patent Application No. 60/604,982, entitled "Advancements in paving technology," which was filed on Aug. 27, 2004, the disclosure of which is expressly incorporated herein by reference.

TECHNICAL FIELD

The present disclosure relates generally to an asphalt-removing work machine and, more particularly, to an asphalt-removing work machine having a funnel-shaped ramp.

BACKGROUND

Many miles of asphalt-surfaced roadways have been built to facilitate vehicular travel. Depending upon usage density, base conditions, temperature variation, moisture variation, and/or physical age, the asphalt surface eventually becomes misshapen, non-planar, unable to support wheel loads, or otherwise unsuitable for vehicular traffic.

In order to rehabilitate the roadways for continued vehicular use, spent asphalt may be removed in preparation for resurfacing. One device utilized for the removal of spent asphalt is described in U.S. Pat. No. 4,560,207 (the '207 patent) issued to Eftefield et al. on Dec. 24, 1985. The '207 patent describes an asphalt processor having a leading edge which is insertable between a ribbon of asphalt and a base to provide separation of the asphalt from a partial width of a roadway surface. A ramp and elevating structure guide the separated asphalt ribbon into a pair of breaker drums, which are rotatable in opposite circumferential directions to bend and facture the asphalt ribbon. As the asphalt ribbon is fractured, the resulting fragments may be deposited in an accompanying transport work machine for hauling away from the worksite.

Although the asphalt processor of the '207 patent may sufficiently remove spent asphalt from a roadway surface, it may be inefficient and width limited. In particular, because the asphalt processor removes spent asphalt from only a partial width of the roadway, many passes may be required to remove all of the spent asphalt from the roadway, which may decrease the efficiency of the rehabilitation process. In addition, the width of the asphalt ribbon removable by the processor of the '207 patent may be limited to the width of the pair of breaker drums. This width limitation could further decrease the efficiency of the asphalt processor.

The disclosed asphalt-removing work machine is directed to overcoming one or more of the problems set forth above.

SUMMARY OF THE INVENTION

In one aspect, the present disclosure is directed to a work machine that includes a removal device and a grinding device. The removal device is configured to remove asphalt from a roadway. The grinding device is configured to fracture the removed asphalt. The work machine also includes a funnel-shaped ramp. The removal device has a width larger than a width of the grinding device, and the funnel shaped ramp is configured to fold the outer edges of the removed asphalt over itself before the removed asphalt reaches the grinding device.

In another aspect, the present disclosure is directed to another method of removing asphalt from a roadway surface.

The method includes separating a layer of asphalt from the roadway surface with a removal device. The method also includes guiding the separated layer of asphalt from the removal device to a grinding device and folding the outer edges of the separated layer of asphalt over itself before the separated layer reaches the grinding device.

DETAILED DESCRIPTION

For the purpose of this disclosure, the term "asphalt" may be defined as a mixture of aggregate and asphalt cement. Asphalt cement may be a brownish-black solid or semi-solid mixture of bitumens obtained as a byproduct of petroleum distillation. The asphalt cement may be heated and mixed with the aggregate for use in paving roadway surfaces, where the mixture hardens upon cooling.

Figure 1:
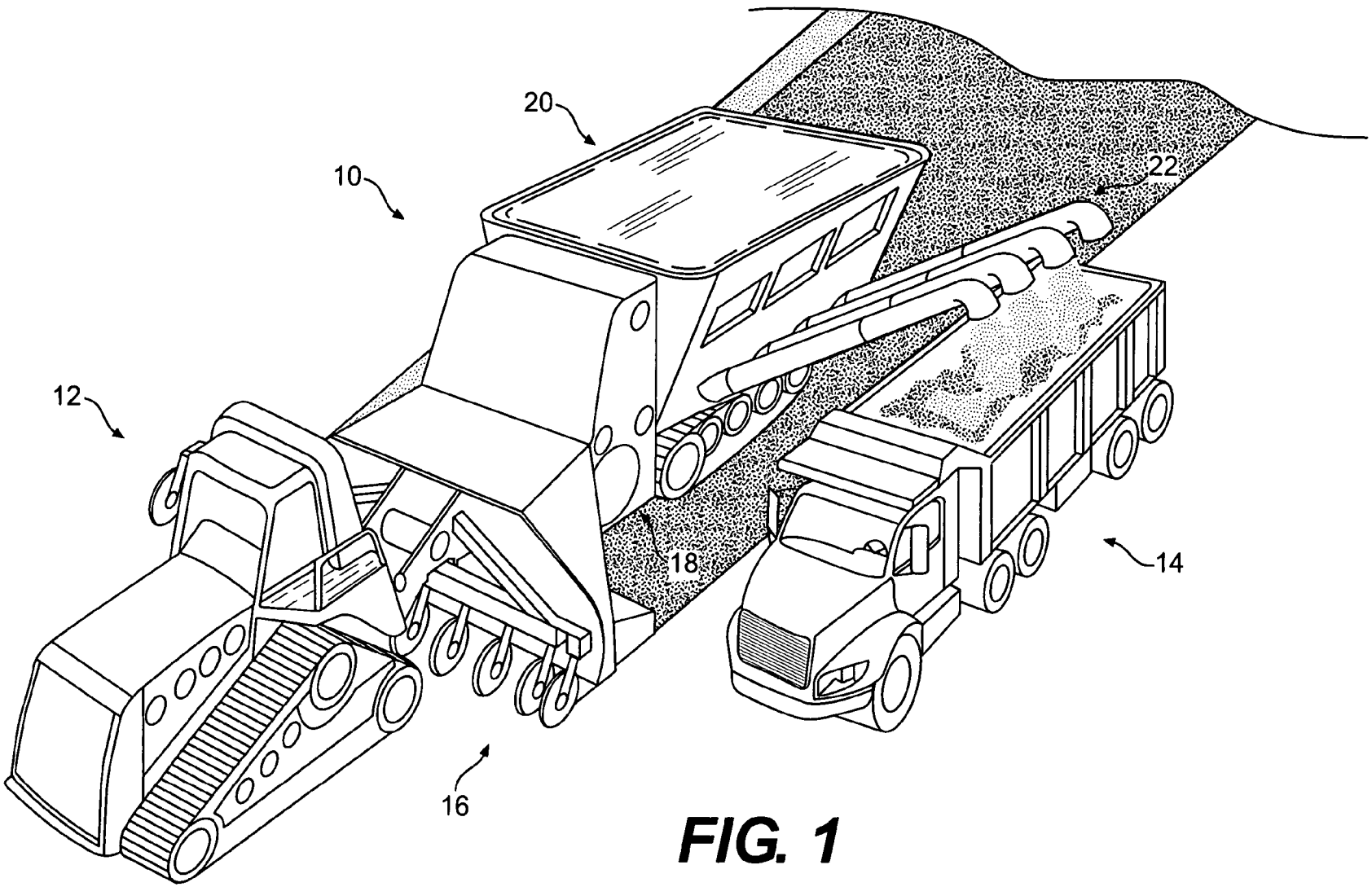
FIG. 1 is a perspective-view illustration of an exemplary disclosed asphalt-removing work machine.

FIG. 1 illustrates an exemplary work machine 10 having multiple systems that cooperate with a tow machine 12 and a transport vehicle 14 to "peel" or remove spent asphalt from a roadway surface. In particular, work machine 10 may embody an asphalt peeler having a removal system 16, a grinding system 18, a storage system 20, and an off-loading system 22. It is contemplated that additional components and systems may be included within work machine 10 such as, for example, an auxiliary power system (not shown).

Tow machine 12 may pull work machine 10 during operation of removal system 16, while transport vehicle 14 may be loaded with removed asphalt during operation of off-loading system 22. Work machine 10 may be pulled by any suitable tow machine 12 such as, for example, a track-type tractor, a haul truck, a wheel loader, a motor grader, or any other tow machine known in the art. Tow machine 12 may be connected to work machine 10 by way of a hitch 23. It is contemplated work machine 10 may alternatively be self-propelled to remove spent asphalt without the use of tow machine 12. The removed asphalt may be off-loaded to any appropriate transport vehicle 14 such as an on-highway haul truck, an off-highway articulated or non-articulated truck, or any other type of transport vehicle known in the art.

Figure 2:
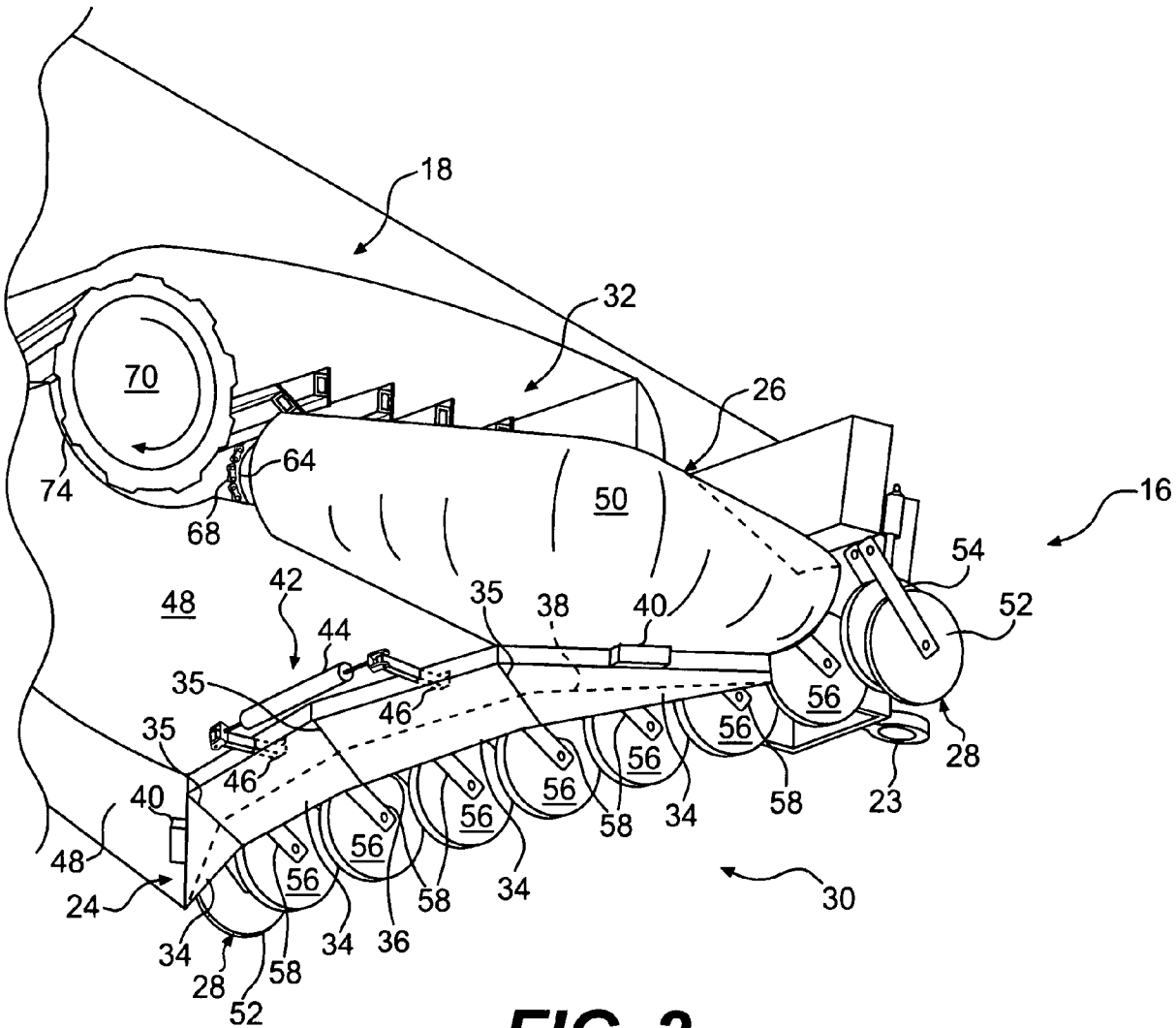
FIG. 2 is a perspective-view illustration of a blade assembly for the asphalt-removing work machine of FIG. 1.

As illustrated in FIG. 2, removal system 16 may include various components that interact to remove asphalt from the roadway surface. Specifically, removal system 16 may include a blade assembly 24 connected to a funnel-shaped ramp 26, one or more scoring devices 28, a roller array 30, and a conveying device 32. Removal system 16 may be configured to remove a layer of asphalt from the entire width of the roadway surface or from only a portion of the roadway surface at varying depths and contours.

Blade assembly 24 may include multiple blade members 34. Each of blade members 34 may be interconnected by way of hinges 35 and configured to move somewhat independent of each other. In this manner, the contact region between blade assembly 24 and the roadway surface may be adjusted to provide for varying widths, thicknesses, and contours of asphalt removal. For example, outer blade members 34 may be lowered relative to the roadway surface, while inner blade members 34 may be raised to substantially match the crowning profile of the roadway surface. It is contemplated that blade assembly 24 may alternatively include a single integral blade structure.

Each of blade members 34 may include a leading edge 36, which may be forced into an asphalt layer or between an asphalt layer and a base for separating the asphalt layer as work machine 10 is advanced by tow machine 12. Leading edge 36 may have a serrated shape with alternating longitudinal recesses (not shown) and extensions (not show). It is contemplated that leading edge 36 may alternatively have a shape other than serrated such as, for example, straight, without recesses or extensions.

One or more of blade members 34 may be heated to soften the asphalt prior to separation. In particular, the heated blade member(s) 34 may include or be located proximate a heat source 38. Heat source 38 may embody an electrical resistance circuit, an array of flame-propagating elements, a system to circulate heated fluid, a microwave device, or any other type of heat source known in the art. Blade members 34 may be preheated to a temperature near or above the melting temperature of the asphalt prior to engagement with the asphalt. It is contemplated that the temperature of blade members 34 may be variable and adjusted according to one or more properties of the spent asphalt. Elevating the temperature of blade members 34 may reduce the amount of force required to move blade assembly 24 through the asphalt layer, may extend the life of blade assembly 24, and/or may reduce the amount of energy consumed by grinding system 18 during fracturing of the asphalt. It is also contemplated that the asphalt may be heated prior to engagement with blade members 34 by way of flame-propagating elements directing heat toward the roadway surface, a heated fluid sprayed onto the roadway surface, a chemical reaction associated with a chemical deposited on the roadway surface, or in any other appropriate manner.

One or more of blade members 34 may be vibrated to loosen the asphalt during separation. Specifically, the vibrated blade member(s) 34 may include or be connected to a vibration-inducing device 40. Vibration-inducing device 40 may embody a reciprocating hammer disposed within blade member 34 or in contact with blade member 34, a sonic vibration device, a pulsating hydraulic device, or any other vibration-inducing device known in the art. The frequency and/or amplitude of vibration induced within blade members 34 may be adjusted according to one or more properties of the asphalt. Vibrating blade members 34 may reduce the amount of force required to move blade assembly 24 through the asphalt, may extend the life of blade assembly 24, and/or may reduce the amount of energy consumed by grinding system 18 during fracturing of the asphalt.

A quick-locking mechanism 42 may be implemented to attach blade members 34 to funnel-shaped ramp 26. Specifically, quick-locking mechanism 42 may include a hydraulic actuator 44 fixedly connected to funnel-shaped ramp 26 and having dual extending latching mechanisms 46 configured to engage and retain blade members 34. Hydraulic actuator 44 may be actuated to move latching mechanisms 46 between connected and disconnected states. It is contemplated that quick-locking mechanism 42 may alternatively include a manually operated actuator, an electrically operated actuator, a pneumatically operated actuator, or any other type of actuator known in the art for moving latching mechanisms 46 between states. It is further contemplated that each hydraulic actuator 44 may alternatively include only a single latching mechanism. Quick-locking mechanisms 42 may facilitate easy replacement of blade members 34. It is also contemplated that quick-locking mechanism 42 may be used to position and or orient each blade member 34 to change the contour of asphalt removal.

Figure 3:
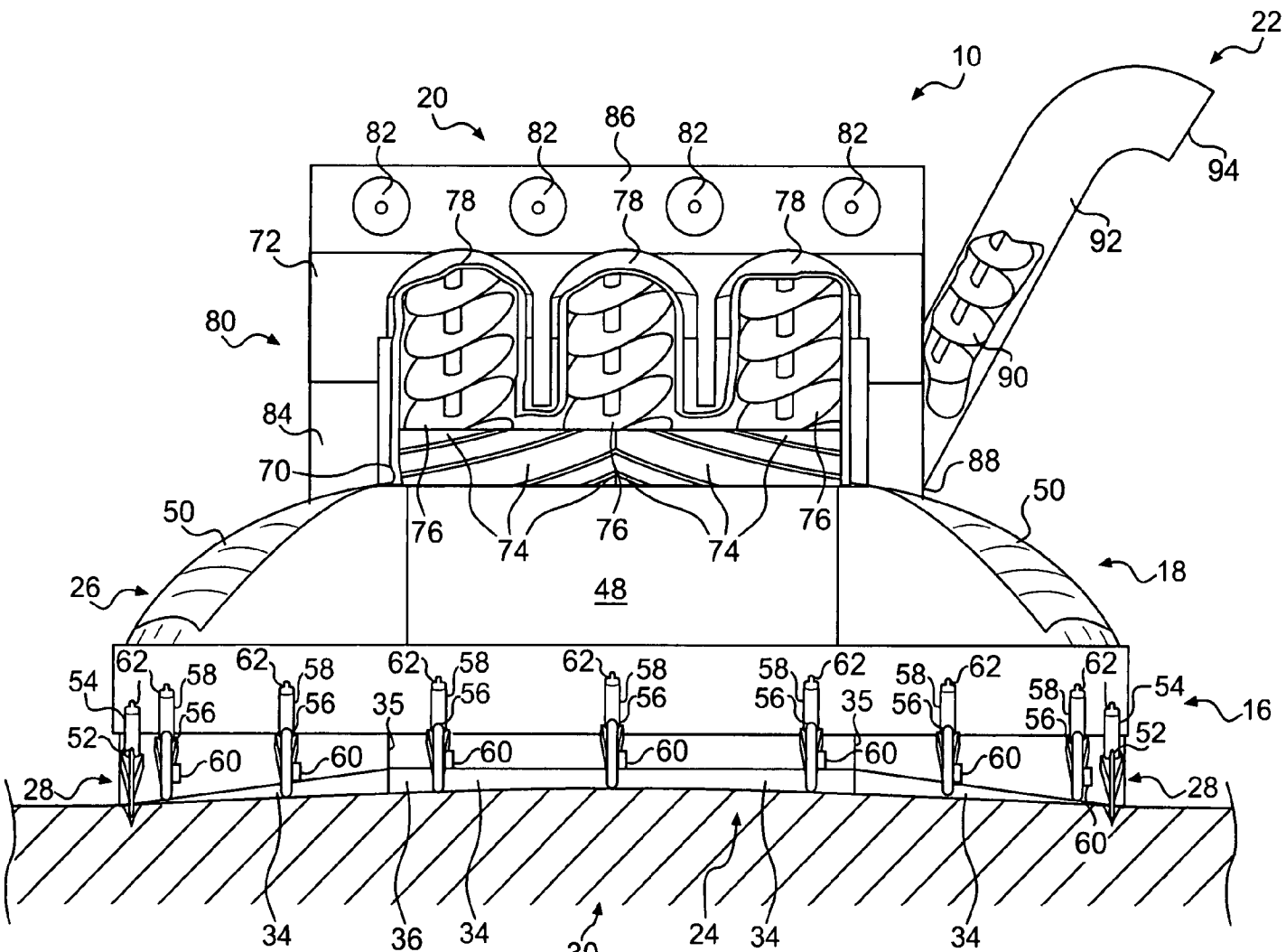
FIG. 3 is a front view illustration of the blade assembly of FIG. 2.

As illustrated in FIG. 3, funnel-shaped ramp 26 may be configured to reduce a width of the removed asphalt and to guide the width-reduced asphalt to grinding system 18. In particular, blade assembly 24 may be configured to remove a layer of asphalt having a width greater than a width of grinding system 18. In order to accommodate this difference in widths, funnel-shaped ramp 26 may reduce the width of the asphalt layer prior to the asphalt layer reaching grinding system 18. To facilitate this width reduction, funnel-shaped ramp 26 may include a ramp surface 48 and curved side members 50. As a layer of removed asphalt proceeds up ramp surface 48, the outer edges of the asphalt layer may contact curved side members 50. As movement of the asphalt layer continues toward grinding system 18, curved side members 50 may urge the outer edges upward and back toward a center of the asphalt layer, thereby bending or folding the outer edges of the asphalt layer over itself resulting in a reduced width of the asphalt layer.

Scoring devices 28 may be configured to score the roadway surface prior to separation of the asphalt layer. Specifically, scoring devices 28 may include a vertical blade 52 pivotally mounted to work machine 10 by way of a hydraulically-movable arm 54 located on either side of and forward of blade assembly 24. Vertical blade 52 may be forced downward into the roadway surface by hydraulically-movable arm 54 during movement of work machine 10 to cut an outer separation boundary of the asphalt layer subsequently removed by blade assembly 24. The outer separation boundary cut into the roadway surface may facilitate clean separation of the asphalt layer. It is contemplated that scoring devices 28 may be heated and/or vibrated to facilitate cutting of the outer separation boundary. It is further contemplated that a saw having hardened teeth may be substituted for vertical blade 52 when separating thick or very firm layers of asphalt.

Roller array 30 may include multiple wheels 56 configured to control the depth of blade assembly 24 into the roadway surface and the resulting thickness of the removed asphalt layer. In particular, each wheel 56 may be pivotally mounted to work machine 10 by way of a hydraulically-movable arm 58. Hydraulic pressure may urge hydraulically-movable arms 58 toward the roadway surface and, in turn, pivot blade assembly 24 away from the roadway surface. A velocity and amount of the fluid applied to hydraulically-movable arms 58 may be directly proportional to the speed and distance that blade assembly 24 moves relative to the roadway surface. It is contemplated that hydraulically-movable arm 58 may be moved in a manner other than hydraulically such as, for example, electrically, pneumatically, manually, or in any other suitable manner.

Roller array 30 may be configured to pull the asphalt layer toward blade assembly 24. Specifically, roller array 30 may include one or more motors 60 associated with one or more wheels 56. Motors 60 may be electrically powered, hydraulically powered, pneumatically powered, or powered in another manner to drive wheels 56. As wheels 56 are driven, force may be imparted to the asphalt layer in the direction of blade assembly 24.

Roller array 30 may also be configured to sense one or more properties of the roadway surface prior to separation of the asphalt layer. For example, a sensor 62 may be associated with one or more wheels 56 and configured to monitor a parameter of wheels 56 indicative of a property of the roadway. The parameter may include, for example, a rolling resistance of wheel 56 that may be indicative of a compaction of the roadway surface. It is contemplated that other parameters of wheels 56 may be also be monitored such as, for example, a vertical movement of wheel 56, a pressure of the fluid within hydraulically-movable arm 58, or any other suitable parameter. These parameters may be indicative of a condition of the asphalt surface, a condition of a base surface under the asphalt layer, a thickness of the asphalt surface or base, a profile of the asphalt surface or base, or any other roadway property known in the art.

The property of the roadway may be used to control operation of work machine 10. In particular, temperature or vibration characteristics of blade assembly 24, the travel speed of work machine 10, the depth of the separated asphalt layer, the position and/or orientation of blade members 34, or any other appropriate operation of work machine 10 may be adjusted in response to the roadway property monitored by sensor 62. It is contemplated that the roadway property may also be transmitted to other work machines affecting resurfacing of the roadway preceding or following the removal process.

Figure 4:
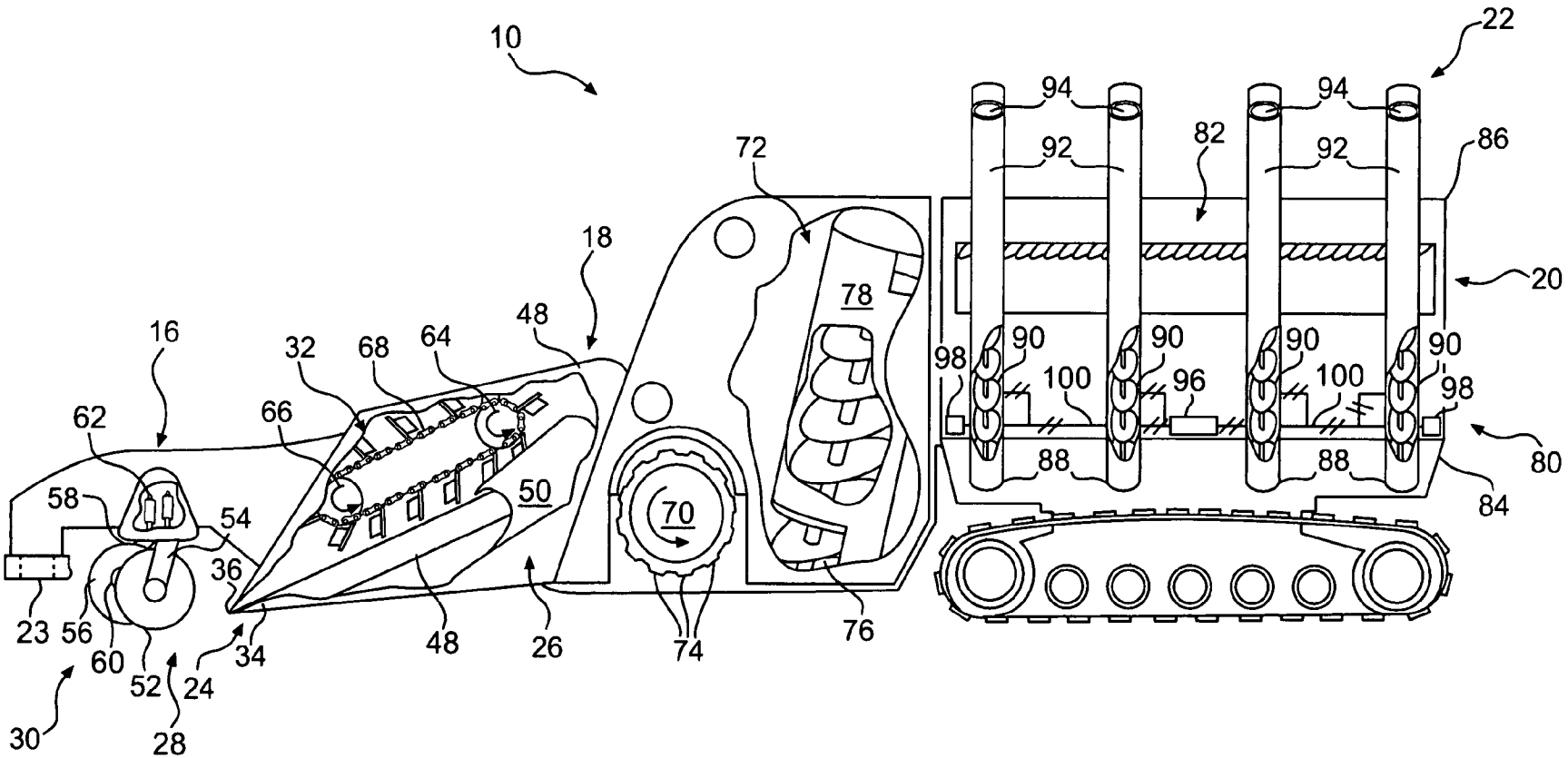
FIG. 4 is a side-view illustration of the asphalt-removing work machine of FIG. 1.

As illustrated in FIG. 4, conveying device 32 may be configured to urge the layer of asphalt layer separated by blade assembly 24 up ramp surface 48 toward grinding system 18. For example, conveying device 32 may embody a chain-driven paddle drag device having a drive roller 64, one or more idlers 66, and a surrounding belt structure 68. Drive roller 64 may drive belt structure 68 about idlers 66 such that belt structure 68 engages an upper surface of the separated asphalt layer and urges the separated asphalt layer toward grinding system 18. It is contemplated that conveying devices other than chain-driven paddle drag devices may be used to urge the asphalt layer up ramp surface 48 such as, for example, a hydraulic push plate, a screw-conveyor, or any other conveying device known in the art.

Grinding system 18 may include various components that interact to fragment the asphalt layer removed from the roadway surface and to deposit the fragments into storage system 20. Specifically, grinding system 18 may include a grinding device 70 and a conveying device 72. Grinding device 70 may feed fragmented asphalt to conveying device 72.

Grinding device 70 may be configured to fragment the removed asphalt. In one example, grinding device 70 may embody a rotary milling drum having oppositely oriented sets of helical teeth 74 used for cutting and/or shaping the removed asphalt layer. It is contemplated that grinding device 70 may alternatively include multiple milling drums rotated in opposition to each other. It is further contemplated that grinding device 70 may embody a different structure for fragmenting the asphalt layer such as, for example, oppositely rotated breaker drums having individual radially-directed intermeshing teeth, a sonic fragmenting device, reciprocating hammers, high pressure fluid jets, or any other suitable fragmenting structure.

The feed speed of conveying device 32 and the rotational speed, position, and/or helical tooth properties of grinding device 70 may be adjusted to affect the dimension of the ground asphalt fragments. For example, the speed of conveying device 32 and/or grinding device 70 may be increased or slowed to change the fragment length, grinding device 70 may be lowered or raised relative to ramp surface 48 to change the fragment thickness, and the helical tooth angle of grinding device 70 may be changed to vary the fragment width. It is contemplated that additional or different parameters of grinding device 70 may be adjusted to alter the dimensions of the asphalt fragments.

Conveying device 72 may be configured to move the fragmented asphalt from grinding system 18 into storage system 20. For example, conveying device 32 may include a screw conveyor 76 disposed within a tubular housing 78. Screw conveyor 76 may be rotated to elevate fragments of asphalt within tubular housing 78 from grinding device 70 to storage system 20. As the asphalt fragments exit an upper end of tubular housing 78, they may drop into storage system 20. It is contemplated that conveying devices other than screw conveyors may be used to urge the asphalt layer up into storage system 20 such as, for example, a hydraulic push plate, a chain-driven paddle-type conveyor, or any other conveying device known in the art.

Storage system 20 may include components configured to evenly store fragmented asphalt. In particular, storage system 20 may include a storage bin 80 and one or more distribution devices 82. Distribution devices 82 may spread the fragmented asphalt from a front portion of storage bin 80 throughout storage bin 80 to accommodate a greater load of fragmented asphalt and even wear of work machine 10. It is contemplated that distribution devices 82 may be omitted, if desired.

Storage bin 80 may be a substantially box-like structure configured to house the fragments of asphalt and to minimize exposure of the fragments to adverse weather conditions. In particular, storage bin 80 may include a trough member 84 and a cover 86. Trough member 84 may have a generally sloping underside to guide the fragments of asphalt downward toward one or more openings 88 during an off-loading process. Cover 86 may be spaced apart from trough member 84 to allow the deposition of fragmented asphalt from conveying device 72, while minimizing the affects of weather such as, for example the accumulation of moisture, extended exposure to sunlight or wind, or other undesirable weather affects. It is contemplated that cover 86 may be omitted, if desired. It is further contemplated that, in addition to sloping downward, the underside of trough member 84 may slope forward or rearward to facilitate the off-loading process from a single opening 88.

Each distribution device 82 may be connected to storage bin 80. In one example, distribution device 82 may embody a screw conveyor have a first end connected to a fore portion of cover 86, and a second end connected to an aft portion of cover 86. As fragmented asphalt builds toward the fore portion of storage bin 80, the screw conveyor may move the asphalt rearward. It is contemplated that distribution devices other than screw conveyors may be utilized to distribute deposited asphalt fragments such as, for example, hydraulic push plates, chain-driven paddle-type conveyors, or any other conveying devices known in the art. It is further contemplated that, in addition to distributing the deposited asphalt fragments in a rearward direction, distribution devices 82 may also distribute the asphalt fragments transversely outward toward the sides of storage bin 80. It is yet further contemplated that distribution devices 82 may be manually actuated, run continuously, or automatically actuated in response to a buildup of fragmented asphalt.

Off-loading system 22 may be configured to unload fragmented asphalt from a side of work machine 10. In particular off-loading system 22 may include a plurality of screw conveyors 90, each disposed within an associated tubular housing 92 that is connected to openings 88. As screw conveyors 90 are rotated, the asphalt fragments may be elevated within tubular housing 92 toward an open end 94, where the fragments may be allowed to drop into transport vehicle 14 (referring to FIG. 1). As the asphalt fragments are transported away from openings 88, additional fragments may migrate down the sloped surfaces of storage bin 80 into tubular housing 92. It is contemplated that off-loading system 22 may alternatively implement devices other than screw conveyors 90 to move asphalt fragments from storage bin 80 into transport vehicle 14 such as, for example, hydraulic push plates, chain-driven paddle-type conveyors, or any other conveying devices known in the art.

Off-loading system 22 may be configured to unload storage bin 80 during operation of removal system 16. In particular, as transport vehicle 14 aligns with off-loading system 22, off-loading system 22 may unload storage bin 80. Unloading of storage bin 80 may possible during travel of work machine 10, during removal of spent asphalt, during grinding of removed asphalt, and/or during any other operation of work machine 10.

Off-loading system 22 may be automated. Specifically, off-loading system 22 may be configured to unload storage bin 80 in response to transport vehicle approaching work machine 10. In one example, off-loading system 22 may include a controller 96 in communication with one or more position sensors 98 and screw conveyors 90 via communication lines 100. Position sensors 98 may be configured to relay a relative position of transport vehicle 14 to controller 96, while controller 96 may be configured to sequentially actuate screw conveyors 90 of off-loading system 22 as transport vehicle 14 moves past work machine 10. In this manner, the forward progress of both work machine 10 and transport vehicle 14 may be substantially unaffected by the off-loading process. It is contemplated that controller 96 may alternatively actuate all screw conveyors 90 once transport vehicle is fully in position. It is further contemplated that the off-loading process may be manually initiated.

Controller 96 may also be in communication with other components to affect operation of work machine 10. For example, controller 96 may be in communication with sensor 62, heat source 38, vibration-inducing device 40, grinding device 70, tow machine 12, quick-locking mechanism 42, motor 60, and other work machines (not shown) via multiple communication lines (not shown). Controller 96 may be configured to affect operation of the components and systems of work machine 10 in response to the roadway property monitored by sensor 62 and/or to transmit the monitored property to other work machines. It is contemplated that work machine 10 may include separate controllers for the sequential automation of screw conveyors 90 and the controlling of work machine functions in response to the monitored roadway property.

Controller 96 may embody a single microprocessor or multiple microprocessors that include a means for controlling an operation of off-loading system 22. Numerous commercially available microprocessors can be configured to perform the functions of controller 96. It should be appreciated that controller 96 could readily embody a general work machine microprocessor capable of controlling numerous work machine functions. Various other known circuits may be associated with controller 96, including power supply circuitry, signal-conditioning circuitry, solenoid driver circuitry, communication circuitry, and other appropriate circuitry.

Position sensor 98 may interact with transport vehicle 14 to determine a position of transport vehicle 14 relative to work machine 10. In particular, position sensor 98 may embody an optical sensor configured to visually recognize a portion of transport vehicle 14 or an indicia located on transport vehicle 14, an RF receiver configured to communicate with an RF tag or transmitter located on transport vehicle 14, a GPS device configured to receive position information for transport vehicle 14 from a satellite or local tracking system, or any other position sensing device known in the art.

INDUSTRIAL APPLICABILITY

The disclosed work machine finds potential application in road rehabilitation processes where efficient removal of spent asphalt is desired. The disclosed work machine removes the spent asphalt, grinds the removed asphalt, and stores the ground asphalt until an efficient opportunity is presented for unloading the stored asphalt. The operation of work machine 10 will now be explained.

As illustrated in FIG. 1, work machine 10 may be towed to remove spent asphalt from a roadway surface. As work machine 10 is towed forward, heated and/or vibrated blade assembly 24 may be forced into an asphalt layer, between an asphalt layer and a base, or into the base to remove a layer of spent asphalt. Blade members 34 may be adjusted to produce a layer of spent asphalt having a substantially equal thickness or, alternatively, to produce a layer of spent asphalt having a predefined contour. The thickness of the removed asphalt layer may be customized by modifying a relative position of wheels 56 to raise or lower blade members 34. In addition to affecting the thickness of the removed asphalt layer, wheels 56 in conjunction with sensors 62 may sense properties of the roadway surface and change operation of work machine 10 in response to the properties.

As the layer of spent asphalt is removed, it may be directed toward grinding device 70. In particular, conveying device 32 may pull the removed asphalt layer toward grinding device 70 where the layer may be fragmented or ground to desired dimensions. The dimension of the asphalt fragments may be adjusted by modifying speed parameters of work machine 10 and/or position parameters of grinding device 70. After fragmentation, the spent asphalt may be directed to storage system 20 by way of conveying device 72.

The fragments of ground asphalt may be housed within storage bin 80 until transport vehicle 14 is in an off-loading position or is approaching the off-loading position. In order to accommodate a greater amount of ground asphalt without spillage, the asphalt fragments deposited within storage bin 80 may be substantially equally distributed by way of distribution devices 82. As transport vehicle 14 approaches work machine 10, position sensor 98 may trigger the sequential activation of screw conveyors 76 to load transport vehicle 14 as it passes by work machine 10.

Heating and vibrating blade assembly 24 and/or scoring devices 28 during asphalt removal may improve the efficiency of work machine 10. In particular, heating of the asphalt, blade assembly 24, and/or scoring devices 28 before and/or during engagement may soften the asphalt and require less blade force and grinding power. Similarly, vibration of blade assembly 24 and/or scoring devices 28 may result in less blade force and grinding power consumption.

Funnel-shaped ramp 26 may also improve the efficiency and productivity of work machine 10. Specifically, because funnel-shaped ramp 26 reduces the width of the removed asphalt to a size manageable by grinding device 70, a wider swath of roadway may be processed in a single pass than if blade assembly 24 only removed a swath that is width limited by grinding device 70. The larger width capacity of work machine 10 may allow for a reduced number of passes to completely remove a roadway surface, thereby decreasing the time, fuel consumption, and wear of work machine 10 associated with the removal process.

Sensors 62 may also help improve the productivity, efficiency, or component life of work machine 10. For example, sensors 62 may determine a property of the roadway surface that affects the manner in which work machine 10 removes and/or processes the roadway surface. Controller 96 of work machine 10 may adjust a temperature or vibration of blade assembly 24 and/or scoring devices 28, a speed of grinding device 70 and/or work machine 10, or any other such parameter in response to the detected property to allow work machine 10 to remove and process the spent asphalt in the most efficient manner. For example, if high compaction of the roadway is detected by sensors 62, work machine 10 may increase the temperature and/or vibration amplitude to soften and loosen the asphalt to a greater degree, thereby increasing a removal or grinding rate of work machine 10 and reducing wear of work machine 10. Conversely, if low compaction is encountered, the temperature and/or vibration amplitude may be reduced to conserve energy.

Quick locking mechanism 42 may facilitate efficient maintenance of work machine 10. In particular, quick locking mechanism 42 may facilitate quick removal and replacement of blade members 34, as compared to a manually intensive processes such as threaded fastening, thermal joining, or other known retention method. The ease of removal and replacement of blade members 34 may correspond to a reduction in the cost and downtime of work machine 10 associated with the maintenance of blade members 34.

It will be apparent to those skilled in the art that various modifications and variations can be made to the asphalt-removing work machine of the present disclosure. Other embodiments of the asphalt-removing work machine will be apparent to those skilled in the art from consideration of the specification and practice of the invention disclosed herein. It is intended that the specification and examples be considered as exemplary only, with a true scope of the disclosure being indicated by the following claims and their equivalents.

What is claimed is:

1. A machine, comprising:

a removal device configured to remove asphalt from a roadway;

a grinding device configured to fracture the removed asphalt; and a funnel-shaped ramp configured to guide the removed asphalt from the removal device to the grinding device;

at least one sensor associated with a plurality of wheels on the machine, the at least one sensor providing an indication of a compaction of the roadway, wherein the removal device has a width larger than a width of the grinding device and the funnel-shaped ramp is configured to fold the outer edges of the removed asphalt over itself before the removed asphalt reaches the grinding device.

2. The machine of claim 1, further including a conveying device configured to urge the removed asphalt up the funnel-shaped ramp.

3. The machine of claim 2, wherein the conveying device is a paddle-drag device.

4. The machine of claim 1, further including a heating device configured to heat the removal device.

5. The machine of claim 1, further including a vibration-inducing device configured to vibrate the removal device.

6. The machine of claim 1, wherein the removal device includes a plurality of blade members, the plurality of blade members interconnected by way of hinges.

7. The machine of claim 6, wherein the plurality of blade members are movable to accommodate the crown of a roadway surface.

8. The machine of claim 6, further including a quick-locking mechanism associated with at least one of the plurality of blade members, the quick-locking mechanism configured to secure the at least one of the plurality of blade members to the machine and to facilitate replacement of the at least one of the plurality of blade members.

9. The machine of claim 1, wherein the grinding device includes a milling drum.

10. The machine of claim 1, further including a scoring device located on each side of the removal device to score the asphalt prior to removal of the asphalt, the scoring of the asphalt facilitating clean removal of the asphalt.

11. The machine of claim 1, wherein the a plurality of wheels are located forward of the removal device relative to a travel direction of the machine and are operatively connected to the removal device, the plurality of wheels providing depth control for the removal device.

12. The machine of claim 1, wherein the funnel-shaped ramp includes at least two curved side members.

13. The machine of claim 1, wherein the funnel-shaped ramp has a first width at an asphalt-entering portion and a second width at an asphalt-exiting portion, the first width being larger than the second width.

14. The machine of claim 1, further including a controller in communication with the sensor and configured to affect an operation of the machine in response to the indication.

15. The machine of claim 11, further including at least one motor associated with the plurality of wheels, the at least one motor configured to drive at least one of the plurality of wheels and draw the asphalt toward the removal device and onto the funnel-shaped ramp.

16. A method of removing asphalt from a roadway surface, the method comprising:

separating a layer of asphalt from the roadway surface with a removal device;

guiding the separated layer of asphalt from the removal device to a grinding device;

folding the outer edges of the separated layer of asphalt over itself before the separated layer reaches the grinding; and sensing a compaction of the asphalt before separating the layer of asphalt.

17. The method of claim 16, further including vibrating the removal device to loosen the layer of asphalt.

18. The method of claim 16, further including heating the removal device to soften the layer of asphalt.

19. The method of claim 16, further including urging the separated layer of asphalt with a paddle-drag device up a funnel-shaped ramp to the grinding device.

20. The method of claim 16, further including scoring the asphalt on either side of the removal device.

21. The method of claim 16, wherein guiding the separated layer of asphalt from the removal device to the grinding device includes guiding the separated layer of asphalt along a ramp having at least two curved side members.

22. The method of claim 16, wherein guiding the separated layer of asphalt from the removal device to the grinding device includes guiding the separated layer of asphalt along a ramp having a first width at an asphalt-entering portion that is larger than a second width at an asphalt-exiting portion.

23. The method of claim 16, further including affecting at least one operation of a machine comprising the removal device in response to the sensed compaction.

24. The method of claim 16, further including urging the asphalt toward the removal device.

25. A machine, comprising:

a removal device configured to remove asphalt from a roadway;

a grinding device configured to fracture the removed asphalt;

a funnel-shaped ramp configured to guide the removed asphalt from the removal device to the grinding device;

a conveying device configured to urge the removed asphalt up the funnel-shaped ramp; and at least one of a heating device configured to heat the removal device and a vibration-inducing device configured to vibrate the removal device, wherein the removal device has a width larger than a width of the grinding device and the funnel-shaped ramp is configured to fold the outer edges of the removed asphalt over itself before the removed asphalt reaches the grinding device.

26. The machine of claim 25, wherein the removal device includes a plurality of blade members, the plurality of blade members interconnected by way of hinges to accommodate the crown of a roadway surface.

27. The machine of claim 25, further including:

a plurality of wheels located forward of the removal device relative to a travel direction of the machine and operatively connected to the removal device, the plurality of wheels providing depth control for the removal device;

at least one sensor associated with the plurality of wheels, the at least one sensor providing an indication of a property of the roadway; and a controller in communication with the sensor and configured to affect an operation of the machine in response to the indication.

28. The machine of claim 27, further including at least one motor associated with the plurality of wheels, the at least one motor configured to drive at least one of the plurality of wheels and draw the asphalt toward the removal device and onto the funnel-shaped ramp.

29. The machine of claim 25, wherein the funnel-shaped ramp includes curved side members.

30. The machine of claim 25, wherein a width of the funnel-shaped ramp progressively narrows from an asphalt-entering portion toward an asphalt-exiting portion.

* * * * *